US005474202A

United States Patent [19]

Moore, Jr.

[11] Patent Number: 5,474,202

[45] Date of Patent: Dec. 12, 1995

[54] METHOD OF MAKING A WATER HEATER AND AN IMPROVED WATER HEATER STRUCTURE

[75] Inventor: H. Jack Moore, Jr., Playa Del Ray, Calif.

[73] Assignee: SABH (U.S.) Water Heater Group, Inc., Bala Cynwyd, Pa.

[21] Appl. No.: 115,436

[22] Filed: Sep. 1, 1993

[51] Int. Cl.[6] ..... B65D 90/06

[52] U.S. Cl. ..... 220/444; 220/445; 220/446

[58] Field of Search ..... 220/444, 445, 220/221, 902, 469, 448, 464, 448, 446

[56] References Cited

U.S. PATENT DOCUMENTS

| | | | |
|---|---|---|---|
| 2,303,126 | 11/1942 | Koppel | 220/445 |
| 3,762,175 | 10/1973 | Jones | 220/445 |
| 3,895,146 | 7/1975 | Nishimaki et al. | 220/902 |
| 4,231,481 | 11/1980 | Nash et al. | 220/445 |
| 4,296,799 | 10/1981 | Steele | 220/445 |
| 4,527,543 | 7/1985 | Denton . | |
| 4,555,837 | 12/1985 | Daugirda et al. . | |
| 4,744,488 | 5/1988 | Nelson | 220/444 |
| 4,901,676 | 2/1990 | Nelson . | |
| 4,945,892 | 8/1990 | Chevalier et al. | 220/445 |
| 4,964,529 | 10/1990 | Houston | 220/445 |
| 5,038,456 | 8/1991 | McGarvey | 220/445 |
| 5,213,728 | 5/1993 | Hickman | 220/444 |

*Primary Examiner*—Stephen J. Castellano
*Attorney, Agent, or Firm*—Miller & Christenbury

[57] ABSTRACT

A method of making a foamed-in-place insulated water heater is provided wherein isolation elements are positioned against a tank around the thermostats and spacer elements are positioned against the tank opposite the isolation elements. The water heater jacket is squeezed into an oval shape elongated to accommodate the passage of the jacket over the isolation elements and spacer elements and positioned around the tank and the squeeze released. The thermostats are protected when foam is then introduced into the annular space between the jacket and tank.

7 Claims, 4 Drawing Sheets

METHOD OF MAKING A WATER HEATER AND AN IMPROVED WATER HEATER STRUCTURE

BACKGROUND OF THE INVENTION

This invention relates to a method of water heater fabrication and a water heater construction resulting therefrom and more particularly to a novel method of foam insulating a water heater.

Water heaters are manufactured and used in large numbers throughout the world. Water heaters often comprise a cylindrical tank containing a body of water, a cold water inlet, a hot water outlet, a body of insulation surrounding the tank and a mechanism for heating the body of water contained within the tank. Many water heaters heat the body of water contained within the tank by means of electrical heating elements penetrating the tank through its cylindrical side wall. Since the heating elements sometimes fail before the expiration of the useful life of the water heater, the heating elements are often removably mounted in the tank. A thermostat is often mounted on the tank adjacent the heating elements and controls the flow of electric current to the heating elements.

Recently, insulation of water heaters has taken the form of foam insulation surrounding the tank, which is in turn surrounded by a sheet metal jacket. The foam insulation is created in place by introducing foam forming materials into the volume defined by the exterior of the tank and the interior of the sheet metal jacket and allowing this material to form foam and fill the volume. In this method of manufacturing a water heater, steps must be taken to prevent the foam material from penetrating into areas from which it must be excluded. One method of performing this task is described in Denton 4,527,543 and uses a plastic film envelope to contain the body of foaming materials in selected areas. Insulation around the entry points for electric heating elements and the like is achieved through use of flexible fiberglass or a pre-molded rigid polyurethane foam insulation body protected by the envelope. This method uses a large plastic envelope which must be manufactured for each water heater positioning the envelope within the water heater prior to introducing the foam and introducing the foaming forming materials into the envelope only. An inventory of envelopes is required. An additional step in fabrication of the water heater is required and wastage in the form of torn envelopes and the like created in the manufacturing process may result.

Other methods using flexible sealing materials have also been attempted. These methods, generally, require additional parts which must be in inventory and often require extra manufacturing steps.

OBJECTS OF THE INVENTION

An object of the invention is to provide a method of foam insulating hot water heaters which is economical, requires a minimum of parts and results in a well-insulated, finished product.

Another object of the present invention is to provide a method of insulating a water heater in which a uniform body of insulation surrounds the water containing tank and the insulation has constant insulating characteristics over the entire surface of the tank except those areas from which insulation is excluded.

It is yet another object of the present invention to provide a method for fabricating a water heater which is easily implemented in a mass production setting.

It is still another object of the present invention to provide a water heater comprising a minimum of parts and a uniform insulating characteristic.

It is yet another object of the present invention to provide a water heater in which foam-in-place type insulation is excluded from certain areas without the necessity of foam restraining elements other than pre-cast foam isolation elements.

SUMMARY OF THE INVENTION

The present invention contemplates a new and improved method of manufacturing a water heater using foam insulation which overcomes the above problems and others and provides a simplified and economical method of foam insulating a water heater and a well-insulated, finished water heater.

In accordance with the invention, there is provided a method of manufacturing a water heater comprising the following steps:

1. providing a generally cylindrical tank having at least one heater opening;
2. providing a generally cylindrical jacket having a diameter larger than the tank;
3. attaching rigid foam isolation elements to the tank around the heater openings, such isolation elements having a thickness approximately equal to one half the difference between the jacket diameter and the tank diameter, a central aperture adapted to allow access to the heater openings, an inner surface having a contour generally matching the curve of the tank and an outer surface having a contour generally matching the curve of the jacket;
4. attaching at least one rigid foam spacer, having a thickness approximately one half the difference between the jacket diameter and the tank diameter, to the tank diametrically opposed to the foam isolation elements;
5. positioning the jacket above the tank;
6. lowering the jacket over the tank and squeezing the jacket to reduce its diameter approximately perpendicular to an imaginary line extending from the isolation elements through the tank to the spacers whereby the jacket diameter along the imaginary line is enlarged to accommodate passage over the isolation elements and the spacer element and sliding the jacket down into finished position relative to the tank and releasing the squeeze;
7. introducing foaming forming materials into the closed volume defined by the tank and the jacket; and,
8. allowing the foaming forming materials to fill the volume between the tank and the jacket with a body of foam insulation.

Further in accordance with the invention, the rigid foam isolation elements are precast from the same material used to form the foamed-in-place insulation surrounding the tank.

Still further in accordance with the invention, the rigid foam isolation elements have an outer perimeter and the central aperture being has an aperture perimeter, the outer perimeter being at least approximately two inches from the central aperture perimeter.

Further objects and advantages of the invention will be apparent from the following detailed description of a preferred embodiment thereof and from the accompanying drawings.

DETAILED DESCRIPTION OF THE INVENTION

Figure 1:
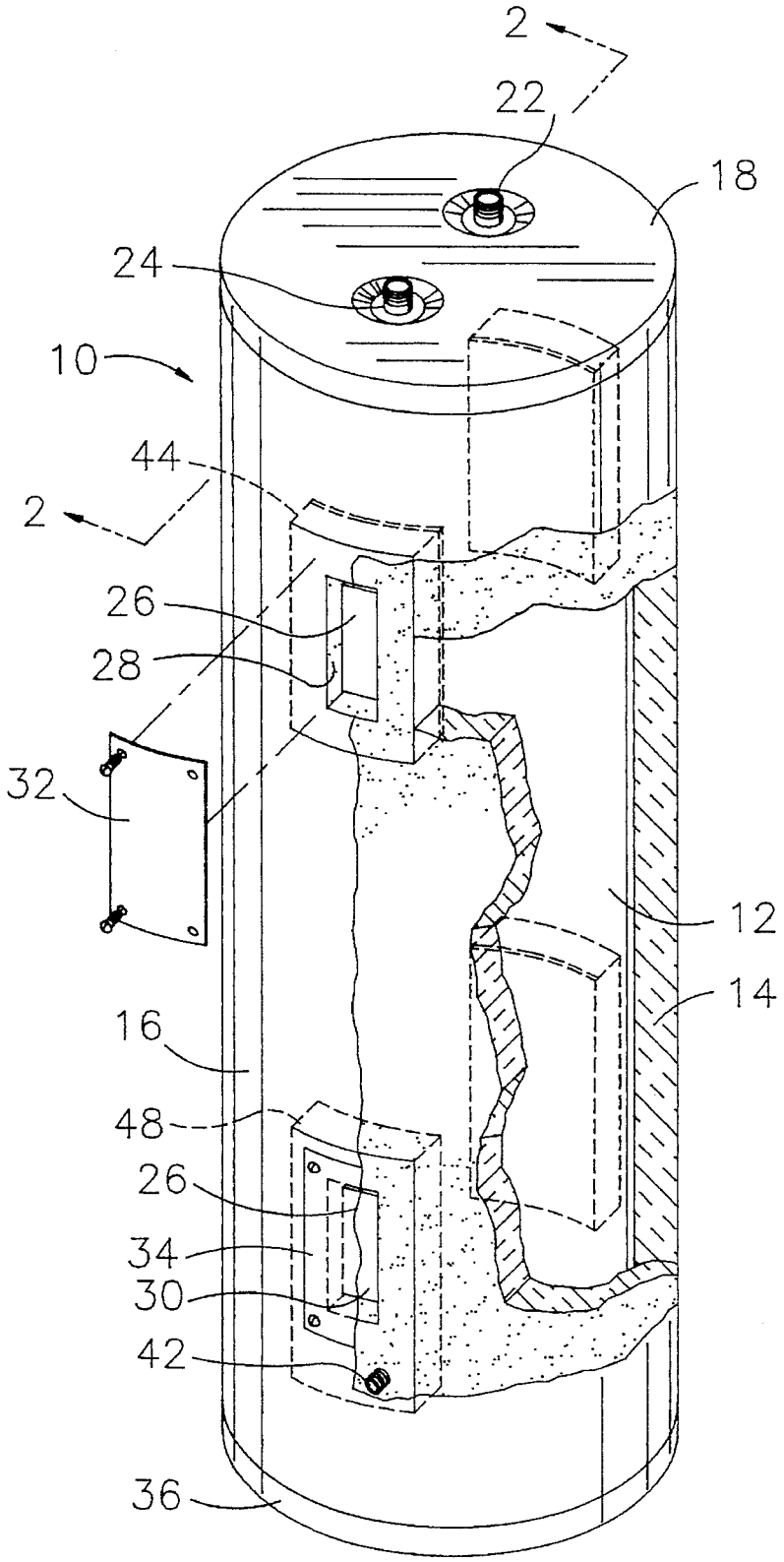
FIG. 1 is a perspective drawing, partially cut away, showing a water heater constructed in accordance with the invention.

Referring now to the drawings, the structures shown are for the purpose of illustrating preferred embodiments of the invention only and not for the purposes of limiting same. The figures in general, and FIG. 1 in particular, show a water heater 10 comprising a water containing tank 12, a body of foam insulation 14, a metallic outer jacket 16 and a metallic jacket top 18. Water is admitted to tank 12 through an inlet 22 and heated water is dispensed from tank 12 through an outlet 24. Water within tank 12 is heated by electrical resistant heating elements 25 shown in FIG. 2, or the like. These electrical heating elements are conventional and provided with current controlled by a thermostat 26. An upper heating element and thermostat are located in an upper access opening 28 and a lower heating element and thermostat are located in a lower access opening 30. Upper access opening 28 and lower access opening 30 are both closed by access plates 32, 34, respectively. A bottom tray 36 completes a metallic jacket completely surrounding tank 12.

Figure 6:
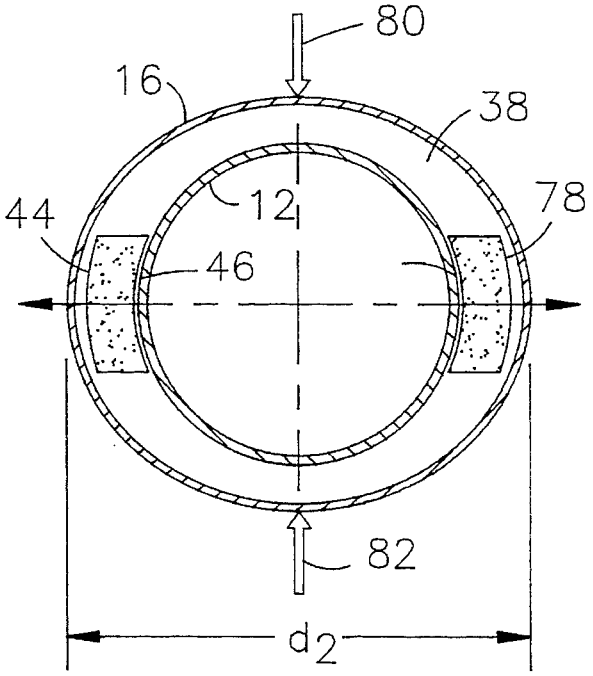
FIG. 6 is a simplified cross sectional view taken along the lines and arrows 3—3 of FIG. 2 showing the squeezing process step in fabricating the water heater shown in FIG. 1.

An annular volume 38 is shown in FIG. 6 defined by tank 12 on the inside and jacket 16 on the outside. For a water heater to be efficient, annular volume 38 must be filled with an insulation material. However, thermostats 26 must be kept free of foam insulation. To accomplish this result, an upper rigid foam isolation element 44 is fixed to tank 12 around upper thermostat 26 by means of a layer of adhesive 46. Similarly, a lower rigid foam isolation element 48 is fixed to tank 12 around lower thermostat 26 by a layer of adhesive 50. Lower rigid foam isolation element 48 differs from upper rigid foam isolation element 44 in that it contains an additional aperture 52 allowing passage of a tank drain 42.

Figure 5:
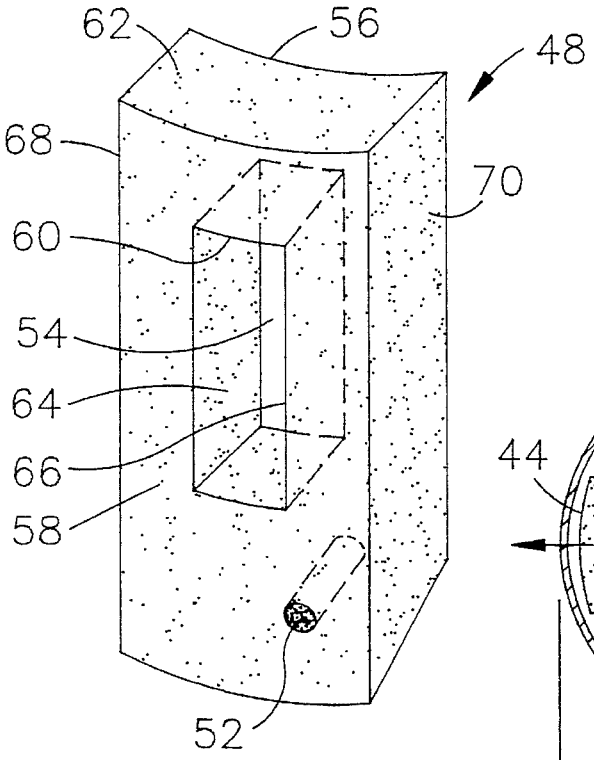
FIG. 5 is a detailed view of the rigid foam insulation element seen in FIGS. 1–4.

As can be seen in FIG. 5, lower rigid foam isolation element 48 has a large central aperture 54 which surrounds and allows access to lower thermostat 26 when installed upon tank 12. The back 56 of rigid element 48 is curved to fit snugly against tank 12. The front 58 is curved to match the contour of the inside surface of the jacket 16. Thus, rigid foam isolation element 48 is a distorted box with one surface having a curve to match the tank curve and the other surface having a curve to match the jacket curve. Central aperture 54 is surrounded on all sides by at least two, and preferably three, inches of rigid foam. Thus, the distance from the top 60 of central aperture 54 to the top 62 of lower rigid foam isolation element 48 is three inches. The distance from side walls 64, 66 of large central aperture 54 to external side walls 68, 70 is at least two inches, and preferably three inches.

The dimensions of upper foam isolation element 44 are similar to the dimensions of lower foam isolation element 48. The side walls of the central aperture and the upper and lower walls of the central aperture are at least two, and preferably three, inches from the side walls and upper and lower walls of the isolation element.

Upper isolation element 44 and the lower isolation element are vertically aligned. As best seen in FIGS. 2, 3, 4 and 6, rigid spacers 72, 74 are attached to tank 12 diametrically opposite rigid isolation elements 44, 48, respectively. Rigid spacers 72, 74 are held on the tank by layers of adhesive 76, 78, respectively.

Figure 2:
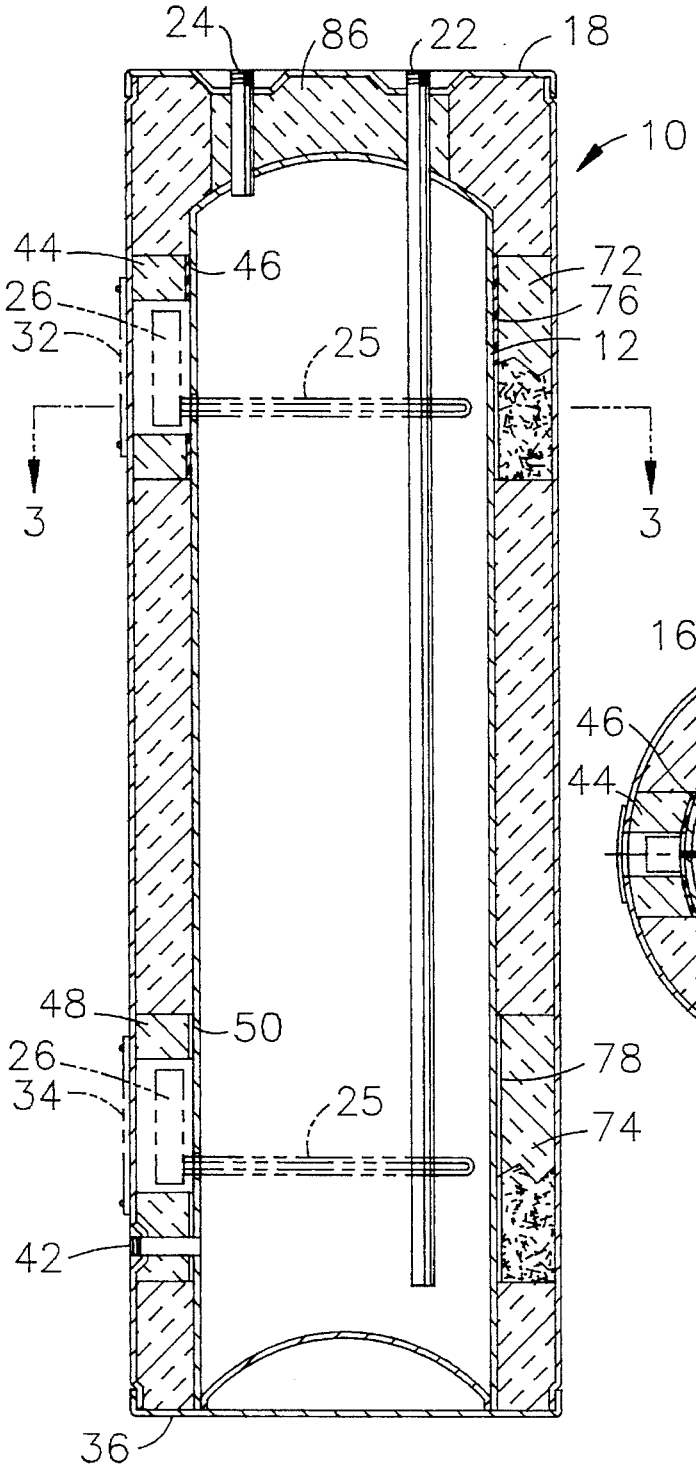
FIG. 2 is a cross section of the water heater of FIG. 1 taken along the lines and arrows 2—2 of FIG. 1.
Figure 3:
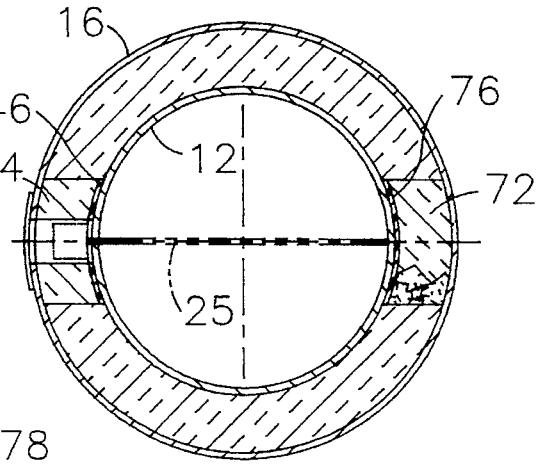
FIG. 3 is a downwardly looking sectional view taken along the lines and arrows 3—3 of FIG. 2.

As can be seen in FIGS. 2 and 3, the thickness of upper rigid foam isolation element 44, lower rigid foam isolation element 48, rigid spacer 72 and rigid spacer 74 are all the same and are all approximately equal to one half the difference between the diameter of outer jacket 16 and tank 12. The thickness of the adhesive layers is negligible. Isolation elements 44, 48 are firmly bound to tank 12 completely around the periphery of thermostats 26 and held in firm contact with the inside surface of outer jacket 16 because of the opposing pressure exerted on jacket 16 by spacers 74.

A tight seal isolating thermostats 26 from annular volume 38 is provided. This is important in foaming operations as expanding foam insulation will try to fill entire volume 38 in all areas not protected from foam intrusion by a seal . The long surface of contact between the inside of jacket 16 and front 58 of the isolation elements prevents the foam from seeping past the isolation elements. Any foam which penetrates past to sides 64, 66, front 58 and top 60 of the isolation element will adhere to the isolation element itself and the jacket inner surface and be prevented from penetrating deeply.

Two inches of contact generally provides a sufficient margin of safety to prevent foam intrusion even should a slight gap exist between the inside of jacket 16 and the front 58 of isolation element 44. However, large gaps must be avoided. Hence, the need for spacers 74 opposite the isolation element. If not for spacers, the foam could, on occasion, simply push the jacket laterally away from the isolation elements, create a large gap and penetrate into the thermostat area.

Figure 7:
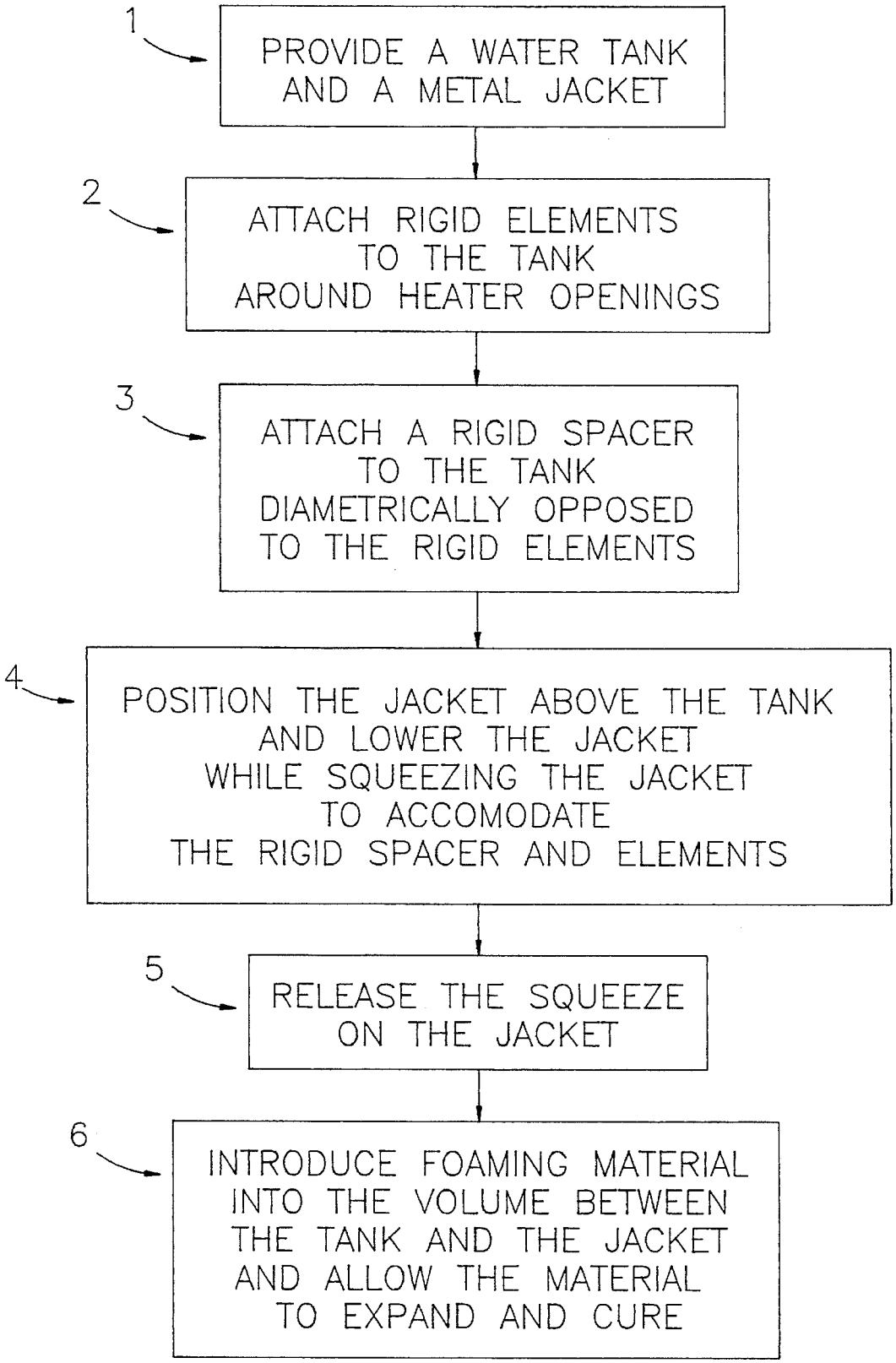
FIG. 7 is a flow chart describing steps employed in the method of fabricating the water heater of FIG. 1.

The method of making the water heater shown in FIGS. 1–6 is described in FIG. 7. Step 1 involves providing a water heater tank constructed along conventional lines as practiced in the industry and providing a conventional outer jacket. The tank is provided with openings and heater elements used in a conventional water heater. The jacket provides access where required and otherwise surrounds the tank.

Step 2 recites placement of rigid isolation elements 44 and 48 to the tank surrounding the space to which a thermostat is normally mounted. The rigid isolation lo elements are preferably molded foam insulation. In the preferred embodiment, the rigid isolation elements are fabricated from the same foam material which will be used to form the foam insulation filling the annular volume 38. In this manner, a uniform insulation quality is provided completely around the water heater.

Step 3 recites placement of rigid spacer elements to the tank opposite the rigid isolation elements. The rigid spacer elements are preferably molded from the same material to be used later to fill the annular volume 38.

Figure 4:
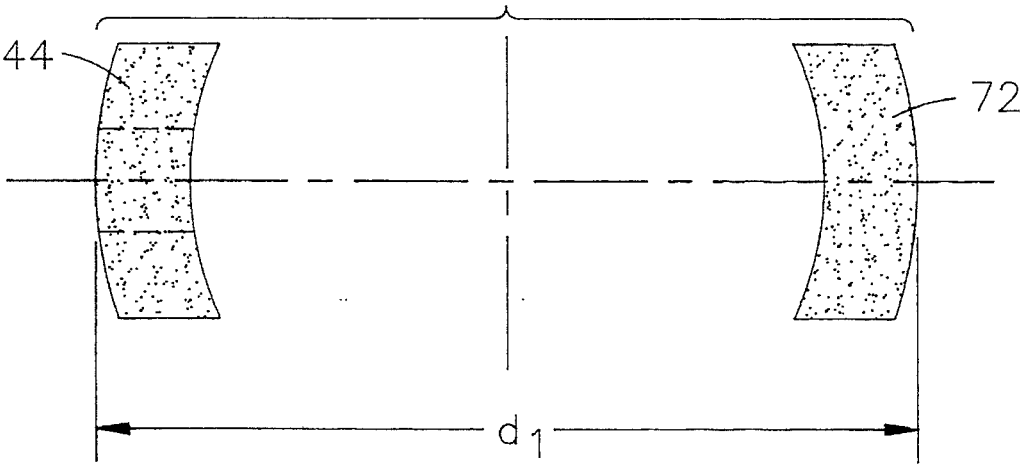
FIG. 4 is a detailed drawing showing alignment of a rigid foam insulation element and a rigid foam spacer element as shown in FIGS. 1–3.

At this point, the tank and isolation and spacer elements have a total diameter d1, as shown in FIG. 4, substantially identical to the inside diameter of jacket 16. Installation of the jacket by lowering it over the tank would therefore be difficult. This difficulty is overcome in step 4 as illustrated in FIG. 6. Jacket 16 is squeezed together as shown by arrows 80, 82 in a direction perpendicular to the diameter d1. This causes the jacket 16 to assume an oval shaped cross section and an enlarged inside diameter d2 as seen in FIG. 6. With the squeezing force applied, jacket 16 is lowered over the tank and spacer assembly until it engages bottom tray 36.

Squeezing force on the jacket 16 is released in step 5.

In step 6, a measured amount of foaming material is introduced into the annular volume 38 and expands and fills the volume completely. As described above, isolation elements 44, 48 prevent the foaming material from intruding into the area surrounding thermostats 26 or drain 42. Once the body of foam insulation 14 expands and cures, a uniform layer of insulation surrounds the side walls of tank 12. As is conventional, a rigid foam top member 86 or other sealing means prevents foam from exiting around inlet 22 and outlet 24.

A finished water heater not requiring the use of an envelope or other expensive additional elements to restrain foaming materials is provided. A method and finished water heater of superior construction, economy of manufacture and uniformity of insulation is provided.

The invention has been described with reference to a preferred embodiment. It will be appreciated that modification or alterations could be made without deviating from the present invention. For example, one could use a foam material, other than the material ultimately used to fill the volume 38, in creating the isolation elements. Another modification would be the retention of the isolation elements and spacer elements on the tank by means of string, hooks or the like surrounding the tank rather than an adhesive bonding. It is intended that all such modifications and alterations be included in so far as they come within the scope of the impended claims or the equivalence thereof.

Having thus described the invention, it is claimed:

1. A water heater comprising:

a generally cylindrical tank having a sidewall having a curve, a diameter and at least one heater opening in said side wall adapted to receive an apparatus adapted to heat a body of water within said tank;

a generally cylindrical jacket having a curve and a diameter larger than said tank diameter surrounding said tank and creating a space between said tank and said jacket;

at least one rigid isolation element having a thickness substantially equal to one half the difference between said jacket diameter and said tank diameter, a central opening adapted to allow access to said tank heater opening, an inner surface having a contour generally matching the curve of said tank and an outer surface having a contour generally matching the curve of said jacket positioned around said heater opening and against said tank;

at least one rigid spacer having a thickness approximately equal to one half the difference between said jacket diameter and said tank diameter positioned against said tank generally diametrically opposed to said isolation element;

a body of foamed in place insulation substantially filling said space except for said central opening.

2. The water heater of claim 1 wherein said isolation element outer surface has an outer surface perimeter and said central opening has a central opening perimeter and said outer surface perimeter and said central opening perimeter are separated by at least about two inches (5 centimeters).

3. The water heater of claim 2 wherein said outer surface perimeter and said central opening perimeter are separated by about three inches (7.5 centimeters).

4. The water heater of claim 1 wherein said heater opening is an upper heater opening and wherein said tank has a lower heater opening, said upper and lower heater openings being vertically aligned with respect to each other, and said tank has a drain in proximity to said lower heater opening; and, said isolation element is an upper rigid isolation element fixed to said tank around said upper heater opening and wherein a lower rigid isolation element is fixed to said tank around said lower heater opening, said lower rigid isolation element including a drain opening accommodating said drain; wherein said spacer is an upper rigid spacer and wherein a lower rigid spacer is located generally diametrically opposed to said lower rigid isolation element.

5. The water heater of claim 1 wherein said spacer has an inner surface having a contour generally matching said curved sidewall and an outer surface having a contour generally matching the curve of said jacket.

6. The water heater of claim 1 wherein said isolation element is polyurethane and said body of foamed in place insulation is polyurethane.

7. The water heater of claim 1 wherein said jacket is positioned around said tank by means of applying squeezing force perpendicular to an imaginary line connecting said isolation element and said spacer prior to assembly.

* * * * *